US011098431B2

(12) United States Patent
Bae

(10) Patent No.: US 11,098,431 B2
(45) Date of Patent: Aug. 24, 2021

(54) METHOD FOR CONTROLLING SPIN-DRYING OPERATION OF WASHING APPARATUS

(71) Applicant: LG ELECTRONICS INC., Seoul (KR)

(72) Inventor: Suncheol Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 164 days.

(21) Appl. No.: 16/332,167

(22) PCT Filed: Sep. 8, 2017

(86) PCT No.: PCT/KR2017/009852
§ 371 (c)(1),
(2) Date: Mar. 11, 2019

(87) PCT Pub. No.: WO2018/048235
PCT Pub. Date: Mar. 15, 2018

(65) Prior Publication Data

US 2019/0264373 A1 Aug. 29, 2019

(30) Foreign Application Priority Data

Sep. 12, 2016 (KR) ..... 10-2016-0117044

(51) Int. Cl.
*D06F 35/00* (2006.01)
*D06F 37/04* (2006.01)
(Continued)

(52) U.S. Cl.
CPC ..... *D06F 34/28* (2020.02); *D06F 33/00* (2013.01); *D06F 35/007* (2013.01); *D06F 37/04* (2013.01);
(Continued)

(58) Field of Classification Search
CPC ..... D06F 33/60; D06F 33/40; D06F 35/007
See application file for complete search history.

(56) References Cited

U.S. PATENT DOCUMENTS 7,596,824 B2 10/2009 Lee
2006/0005319 A1 1/2006 Park
(Continued)

FOREIGN PATENT DOCUMENTS

GB 2270373 3/1994
JP 04256787 9/1992
(Continued)

OTHER PUBLICATIONS

EP Search Report dated Apr. 6, 2020.
International Search Report dated Dec. 20, 2017.

*Primary Examiner* — Spencer E. Bell
(74) *Attorney, Agent, or Firm* — Finnegan, Henderson, Farabow, Garrett & Dunner, LLP

(57) ABSTRACT

A method for controlling a spin-drying operation of a washing apparatus includes a laundry dispersing step of dispersing the laundry inside a drum by accelerating the drum, a spin-drying step including detecting the eccentricity of the drum, and performing spin-drying by rotating the drum to a spin-drying RPM. The laundry dispersing step is re-executed when the eccentricity exceeds a reference eccentricity, and in the spin-drying step, a rotation time during which the drum rotates at the spin-drying RPM is adjusted according to a spin-drying degree. The spin-drying degree is measured after a point in time at which the eccentricity exceeds the reference eccentricity.

10 Claims, 4 Drawing Sheets

(51) Int. Cl.

| | |
|---|---|
| ***D06F 37/22*** | (2006.01) |
| ***D06F 37/30*** | (2020.01) |
| ***D06F 33/00*** | (2020.01) |
| ***D06F 34/28*** | (2020.01) |
| ***D06F 39/00*** | (2020.01) |

(52) U.S. Cl.
CPC ..... *D06F 37/22* (2013.01); *D06F 37/225* (2013.01); *D06F 37/30* (2013.01); *D06F 37/304* (2013.01); *D06F 39/00* (2013.01)

(56) References Cited

U.S. PATENT DOCUMENTS

| | | | |
|---|---|---|---|
| 2009/0300852 | A1 | 12/2009 | Bae et al. |
| 2012/0151691 | A1 | 6/2012 | Jang et al. |
| 2013/0247305 | A1 | 9/2013 | Janicek et al. |

FOREIGN PATENT DOCUMENTS

| | | |
|---|---|---|
| JP | 3433135 | 8/2003 |
| JP | 2006-158764 | 6/2006 |
| KR | 10-0712848 | 5/2007 |
| KR | 10-1155334 | 6/2012 |
| KR | 10-2013-0005041 | 1/2013 |
| KR | 10-1257702 | 4/2013 |
| WO | WO 2000-28128 | 5/2000 |

METHOD FOR CONTROLLING SPIN-DRYING OPERATION OF WASHING APPARATUS

CROSS-REFERENCE TO RELATED APPLICATIONS

This application is a U.S. National Phase entry under 35 U.S.C. § 371 from PCT International Application No. PCT/KR2017/009852, filed Sep. 8, 2017, which claims the benefit of priority of Korean Patent Application No. 10-2016-0117044, filed Sep. 12, 2016, all of which are incorporated herein by reference in their entireties.

TECHNICAL FIELD

The present invention relates to a method for controlling a washing apparatus, and more particularly, a method for controlling a spin-drying operation of a washing apparatus which may shorten a time required for the spin-drying operation of the washing apparatus.

BACKGROUND ART

In general, washing apparatuses are configured to remove contaminants from laundry such as clothes through a washing process of the laundry.

Such washing apparatuses may be divided into a top loading type washing apparatus having a rotary shaft of a drum arranged to be perpendicular to the ground and a front loading type washing apparatus having a rotary shaft of a drum arranged to be parallel to the ground.

In the front loading type washing apparatus, the rotary shaft of the drum is arranged to be substantially horizontal to the ground, and the washing operation is performed in a drum washing manner in which washing is performed using friction between the drum, which is rotated by driving force transmitted from a motor with a detergent, washing water and laundry loaded into the drum, and the laundry, and an impact on dropped laundry. In washing in the drum washing manner, there may be almost no damage to the laundry, the laundry may not be tangled with each other, and an effect of washing through tapping and rubbing may be obtained.

In the top loading type washing apparatus, the rotary shaft of the drum is arranged to be substantially perpendicular to the ground, and the drum is provided inside a tub where washing water is stored. The washing operation is performed in a pulsator manner in which washing is performed with the laundry immersed in the washing water supplied into the drum. In the pulsator manner, washing is performed by friction between the washing water and the laundry caused by rotation of the drum or rotation of a pulsator arranged under the drum to create water streams, and an action of the detergent. Accordingly, washing can be performed only when washing water is supplied as to make the laundry submerged in the washing water, and thus a large amount of washing water is used.

The washing process of the washing apparatus includes a washing operation of washing laundry by supplying washing water and a detergent, a rinsing operation of supplying rinsing water and removing the contaminants and remaining detergent separated from the laundry, and a spin-drying operation of removing water and the like from the laundry from which the contaminants and remaining detergent have been removed.

The spin-drying operation is a process in which water contained in the laundry is removed as the laundry that has undergone the washing and rinsing operations is rotated at a high speed along with the drum. In the spin-drying operation, the drum rotates at a high speed, and accordingly the laundry is not uniformly distributed on the inner circumferential surface of the drum. Rather, the laundry is eccentrically maldistributed to one side, resulting in severe vibration and noise during high-speed rotation of the drum.

Accordingly, in the conventional spin-drying operation, the degree of eccentricity is sensed according to eccentric distribution of the laundry, and when the sensed degree of eccentricity exceeds an allowable eccentricity degree, the rotating drum is stopped or decelerated and then accelerated to uniformly disperse the laundry on the inner circumferential surface of the drum. Then, the drum is rotated at a high speed to remove water from the laundry. In this case, the time for which the drum rotates at spin-drying RPM is usually fixed.

However, if a series of operations is repeated according to the degree of eccentricity exceeding an allowable eccentricity degree as described above, the drum rotates at the spin-drying RPM in the spin-drying operation for the initially fixed time even when water is removed from the laundry to a certain degree in the middle of the repeated operations. As a result, the time required for the spin-drying operation may be excessively long.

Further, in the case where the time for which the spin-drying operation is performed is pre-fixed, the spin-drying operation may be terminated without water sufficiently removed from the laundry.

DISCLOSURE

Technical Problem

An object of the present invention devised to solve the problem lies in a method for controlling a spin-drying operation of a washing apparatus to adjust a time required for the spin-drying operation according to a condition of the laundry in the spin-drying operation.

Technical Solution

The object of the present invention can be achieved by providing a method for controlling a spin-drying operation of a washing apparatus, the method including a fabric dispersion step of dispersing laundry in a drum by accelerating the drum, and a spin-drying step of sensing a degree of eccentricity of the drum and performing spin-drying by rotating the drum to spin-drying RPM, wherein the fabric dispersion step is re-executed when the degree of eccentricity exceeds a reference eccentricity degree, and wherein a rotation time for which the drum rotates at the spin-drying RPM in the spin-drying step is adjusted according to a spin-drying degree measured after an exceeding time at the degree of eccentricity exceeds the reference eccentricity degree.

The spin-drying degree may be set by at least one of the number of times the fabric dispersion step is re-executed and an average RPM of the drum from the exceeding time to a time at which the spin-drying RPM is reached.

The spin-drying degree may be set by at least one of a rotation time and an average RPM of the drum from the exceeding time to a time at which the spin-drying RPM is reached.

The spin-drying step may include a preceding preliminary drying step of rotating the drum at preceding-preliminary-drying RPM such that the laundry is preliminarily spin-dried for the first time, and a following preliminary drying step of rotating the drum at following-preliminary-drying RPM such that the laundry is spin-dried again after the preceding preliminary drying step.

The spin-drying degree may include a first spin-drying degree measured before a time at which the preceding-preliminary-drying RPM is reached, and a second spin-drying degree measured before a time at which the following-preliminary-drying RPM is reached after the first spin-drying degree is measured, wherein a rotation time for which the drum rotates at the following-preliminary-drying RPM in the following preliminary drying step may be adjusted according to the first and second spin-drying degrees.

A rotation time for which the drum rotates at the preceding-preliminary-drying RPM in the preceding preliminary drying step may be fixed.

The following-preliminary-drying RPM may be set to be higher than the preceding-preliminary-drying RPM.

The spin-drying step may include a main spin-drying step of rotating the drum at main-spin-drying RPM such that the laundry is finally spin-dried.

The main spin-drying step may include a main spin-drying acceleration step of accelerating the drum to the main-spin-drying RPM, and a main spin-drying maintenance step of rotating the drum at the main spin-drying RPM after the main spin-drying acceleration step.

An acceleration of the drum in the main spin-drying acceleration step may be adjusted by the spin-drying degree.

A time of entry into the main spin-drying acceleration step may be measured in the main spin-drying step, wherein, when the measured time of entry is later than a preset entry time, an acceleration of the drum in the main spin-drying acceleration step may be set to increase.

Advantageous Effects

As described above, a method for controlling a spin-drying operation of a washing apparatus according to the present invention has the following effects.

First, the spin-drying operation does not take much time even when a fabric dispersion step is repeated several times.

Second, since the time required for the spin-drying operation is adjusted according to the condition of the laundry, the spin-drying operation is terminated after water is sufficiently removed from the fabrics.

Third, energy is saved because spin-drying operation does not take too much time.

BEST MODE

Hereinafter, various embodiments of the present invention will be described in detail with reference to the accompanying drawings. It is to be understood that the following description of the configuration and control method of the apparatus described below are exemplary and explanatory only and are not restrictive of the scope of the invention. Wherever possible, the same reference numbers will be used to refer to the same or like parts.

Unless defined otherwise, all terms used herein have the general meanings as understood by one of ordinary skill in the art. If a term used herein conflicts with the general meaning of the term, it shall be subject to the definition as used herein.

As used herein, terms including ordinal numbers such as first, second, etc. may be used to explain various elements. However, it will be appreciated that the elements are not limited to such terms. These terms are used only to distinguish one element from another.

Furthermore, terms used in this specification are merely adopted to explain specific embodiments, and are not intended to limit the present invention. A singular expression includes a plural expression unless the two expressions are contextually different from each other. In this specification, the term "include" or "have" is intended to indicate that characteristics, figures, steps, operations, constituents, and components disclosed in the specification or combinations thereof exist, and should be understood as not precluding the existence or addition of one or more other characteristics, figures, steps, operations, constituents, components, or combinations thereof.

Figure 1:
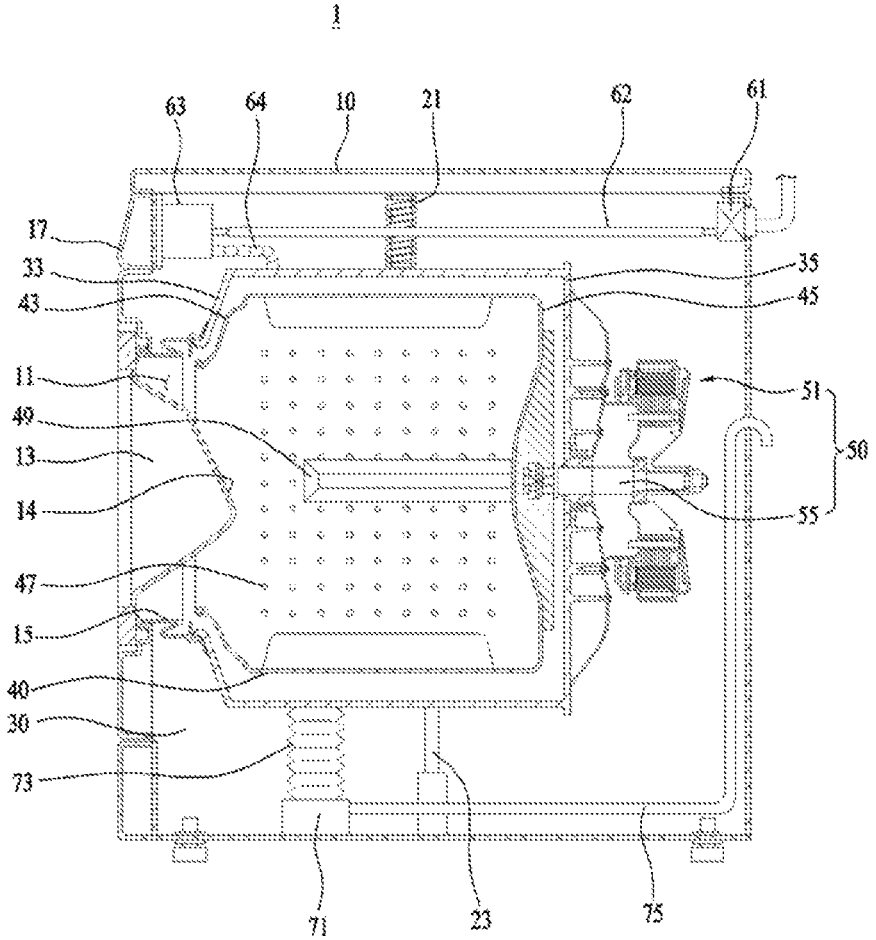
FIG. 1 is a cross-sectional view schematically showing configuration of a washing apparatus according to an embodiment of the present invention.
Figure 2:
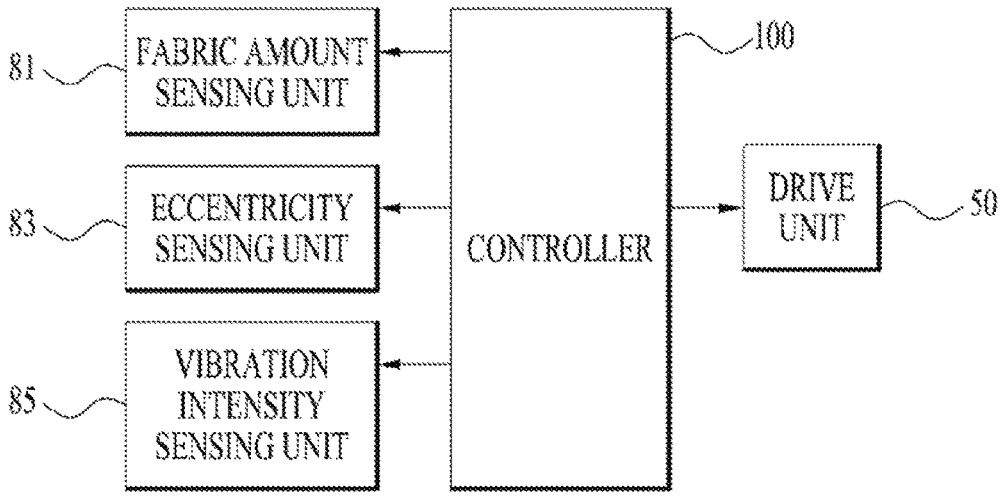
FIG. 2 is a block diagram showing a control relationship between main elements of the washing apparatus shown in FIG. 1.

FIG. 1 is a cross-sectional view schematically showing configuration of a washing apparatus according to an embodiment of the present invention, and FIG. 2 is a block diagram showing a control relationship between main elements of the washing apparatus shown in FIG. 1.

Referring to FIG. 1, a washing apparatus 1 having a drum 40 according to one embodiment of the present invention includes a cabinet 10 having a laundry loading port 11 formed on a front surface thereof, a door 11 openably arranged in the laundry loading port 11 of the cabinet 10, a tub 30 arranged in the cabinet 10 to store washing water, a motor 50 provided to the tub 30 to generate a driving force, a rotary shaft 55 connected to the motor 50, the drum 40 connected to the rotary shaft 55 to wash laundry using the driving force transmitted from the motor 50, and a control panel 17 including an input unit configured to receive various control commands from a user, and a display unit configured to display an operating state of the washing apparatus.

While FIG. 1 shows a direct connection type drive structure in which the motor 50 is directly connected to the rotary shaft 55 to drive the drum 40, embodiments are not limited thereto. In addition, while the figure illustrates that the control panel 17 is provided on the front surface of the cabinet 10, embodiments are not limited thereto.

The cabinet 10 defines an outer appearance of the washing apparatus 1 having the drum 40, and is provided, in the front surface thereof, with the laundry loading port 11 allowing the inside of the cabinet to communicate with the outside therethrough. The door 11 configured to selectively open and close the laundry loading port 11 is pivotably provided on the front surface of the cabinet 10. Accordingly, the user is allowed to load the laundry into the drum 40 or retrieve the laundry from the drum 40 by opening or closing the door 11.

Here, the door 11 is configured such that an inner side surface 14 of the door facing the drum 40 protrudes toward the drum 40. Thus, when the user pushes and closes the door 11, a part of the inner side surface of the door 11 is positioned inside the drum 40. Accordingly, the laundry is washed only within the drum 40. In addition, during washing by rotation of the drum 40, the laundry is not discharged to the outside of the drum 40.

The tub 30 is provided in the cabinet 10 to accommodate washing water. The washing water is supplied into the tub 30 from an external water source. Further, the tub 30 is formed in a substantially cylindrical shape and may be divided into a circumferential surface and opposite end portions. The front end portion of the opposite end portions forms a front surface 33 of the tub 30 and the rear end portion of the tub 30 forms a rear surface 35 of the tub 30. A front opening is formed in the front surface 33 of the tub 30 at a position corresponding to the laundry loading port 11 of the cabinet 10 such that the inside and the outside of the drum 40 communicate with each other.

The circumferential surface of the tub 30 is elastically supported by a spring 21 and a damper 23, which are arranged inside the cabinet 10. Further, the tub 30 is not allowed to rotate because the circumferential surface thereof is directly supported by the spring 21 and the damper 23. Accordingly, unlike the drum 40, the tub 30 receives no rotational force from the motor 50.

A water supply device configured to supply water containing a detergent or clean water containing no detergent into the tub 30 is connected to an upper side of the tub 30.

The water supply device includes a water supply valve 61 configured to regulate clean water supplied through an external hose, a water supply hose 62 configured to guide water passing through the water supply valve 61, a detergent supply device 63 configured to mix and discharge the water supplied through the water supply hose 62 and a pre-stored detergent, and a water supply pipe 64 having one end connected to a discharge port of the detergent supply device 63 and the other end connected to an upper portion of the tub 30 such that the water containing the detergent discharged from the detergent supply device 63 or clean water containing no detergent is guided into the tub 30. The water supply pipe 64 may be formed as a bellows pipe to prevent vibration of the tub 30 from being transmitted to the detergent supply device 63.

A drainage device configured to drain water is connected to a lower side of the tub 30. The drainage device includes a drainage pump 71 configured to supply power for discharging the accommodated washing water from the tub 30, a first drainage pipe 73 having one end connected to the lower side of the tub and the other end connected to the drainage pump 71 to guide the washing water accommodated in the tub 30 to the drainage pump 71, and a second water pipe 75 having one end connected to the drainage pump 71 and the other end connected to the rear surface of the cabinet 10 to discharge the washing water from the drainage pump 71 to the outside of the cabinet 10. The first drainage pipe 73 may be formed as a bellows pipe such that the vibration of the tub 30 is not transmitted to the drainage pump 71.

Since the tub 30 and the cabinet 10 are spaced apart from each other by a predetermined distance, washing water may flow into the gap between the door 11 and the front opening of the tub 30, namely, between the front surface of the cabinet 10 and the front opening of the tub 30. To prevent such inflow of the washing water, a gasket 15 is provided in the gap between the front surface of the cabinet 10 and the front opening of the tub 30. The gasket 15 is formed of a flexible material to prevent vibration of the motor 50 from being transmitted to the cabinet 10 through the gasket 15.

The drum 40 is rotatably arranged in the tub 30 and allows laundry to be loaded thereinto. The drum 40 may be formed in a substantially cylindrical shape. The drum 40 may be divided into a circumferential surface and opposite end portions in the same manner as the tub 30. The front end portion of the opposite end portions of the drum 40 forms a front surface 43 of the drum 40 and the rear end portion forms a rear surface 45 of the drum 40.

The rear surface 45 of the drum 40 is directly connected to the rotary shaft 55 connected to the motor 50 and receives the rotational force from the motor 50. The drum 40 is provided with a lifter 49 on an inner circumferential surface thereof so as to lift and drop a part of the laundry or washing water accommodated therein when the drum 40 is rotated by the motor 50. Accordingly, when the drum 40 is rotated by the motor 50, the lifter 49 functions to lift and drop a part of the laundry or washing water to one side while rotating together with the drum 40.

The drum 40 is provided with a plurality of through holes 47 formed on a side wall thereof, that is, the circumferential surface thereof. The drum 40 communicates with the tub 30 through the plurality of through holes 47. Accordingly, when the washing water is supplied to the tub 30 to a certain level or higher, the drum 40 is immersed in the washing water, and a part of the washing water is drawn into the drum 40 through the through holes 47.

Referring to FIG. 2, the washing apparatus is configured to implement a method for controlling the spin-drying operation, which will be described later. The washing apparatus includes a fabric amount sensing unit 81, an eccentricity sensing unit 83, a vibration intensity sensing unit 85, a drive unit 50, and a controller 100. Here, the fabric refers to the laundry, and the fabric amount refers to the weight of the laundry. Hereinafter, the terms fabric and fabric amount will be used according to the meanings given above.

The fabric amount sensing unit 81 is configured to sense the amount of fabrics loaded into the drum 40 and may sense the fabric amount based on the driving properties of the drive unit 50 that vary according to the fabric amount, for example, the time required to reach a predetermined rotational speed, an acceleration slope or speed increase rate during accelerated rotation, a deceleration slope or speed decrease rate during braking, the time taken until braking, and the like.

The eccentricity sensing unit 83 senses the degree of eccentricity of the drum 40. The eccentricity sensing unit 83 may sense the degree of eccentricity based on the degree of change of the rotational speed of the drive unit 50, which varies depending on the distribution condition of the fabrics in the drum 40. For this purpose, a speed sensing unit configured to sense the rotational speed of the drive unit 50 may be provided separately from the drive unit 50. Alternatively, an output current may be measured using a current sensing unit such as an encoder provided to the drive unit 50, and the degree of eccentricity may be sensed based on a change in the output current.

The vibration intensity sensing unit 85 is configured to sense vibration generated during rotation of the drum 40 and is provided separately from the eccentricity sensing unit 83. The vibration intensity sensing unit 85 may sense a vibration intensity based on the displacement or vibration period of a mass that moves according to the vibration generated during rotation of the drum 40.

The drive unit 50 provides a driving force for rotating the drum 40 or the pulsator (not shown). In the present embodiment, the drive unit includes the motor 50 described above, and the rotary shaft 55 having one end connected to the motor 50 and the other end connected to the drum 40.

The controller 100 controls the drive unit 50 according to a signal input through the input unit and a pre-input process such that the washing process including a washing operation, a rinsing operation, and a spin-drying operation is performed. In performing the washing process, the controller 100 controls the drive unit 50 by continuously receiving signals generated by the fabric amount sensing unit 81, the eccentricity sensing unit 83 and the vibration intensity sensing unit 85, and controls the display unit to display each step through the display unit.

Hereinafter, a control method for the washing apparatus configured as above will be described. The washing apparatus generally includes a washing operation, a rinsing operation, and a spin-drying operation. The control method according to the present invention, particularly, the spin-drying operation will be described in detail with reference to FIGS. 3 and 4.

Figure 3:
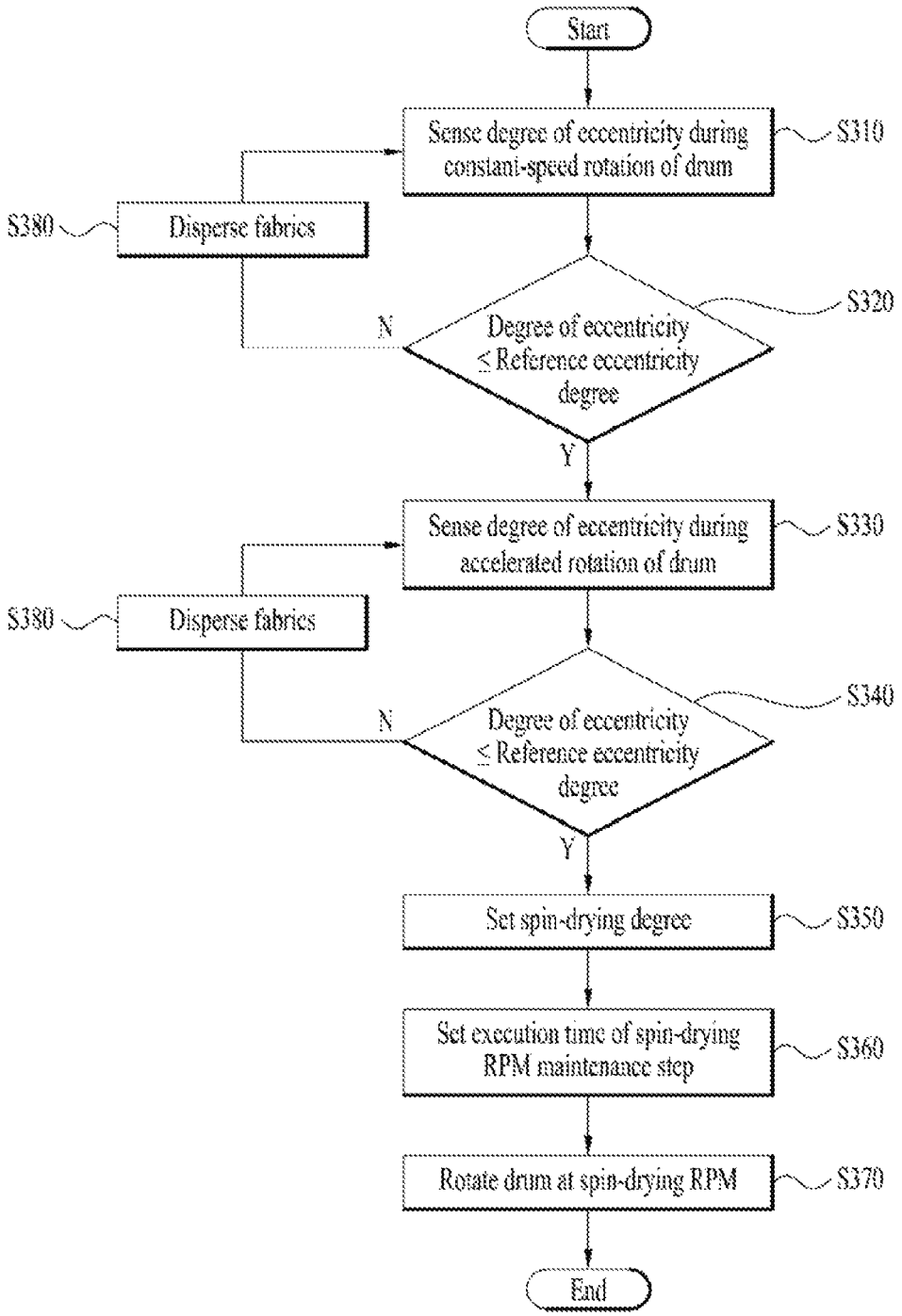
FIG. 3 is a flowchart illustrating a spin-drying step according to an embodiment of the present invention.
Figure 4:
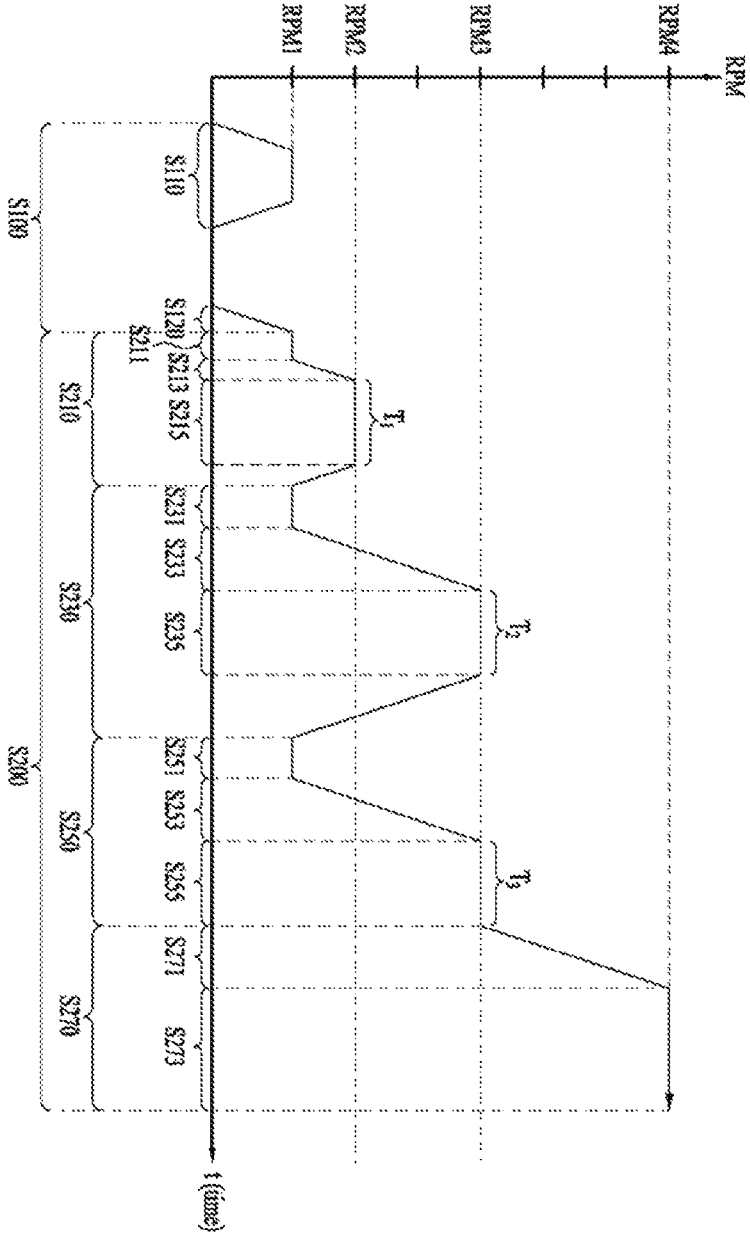
FIG. 4 is a graph depicting a change in rotational speed of a drum with time in a method for controlling a spin-drying operation of a washing apparatus according to an embodiment of the present invention.

FIG. 3 is a flowchart illustrating a spin-drying step S200 according to an embodiment of the present invention. FIG. 4 is a graph depicting a change in rotational speed of the drum 40 with time in a method for controlling a spin-drying operation of a washing apparatus according to an embodiment of the present invention.

Referring to FIGS. 3 and 4, a spin-drying operation control method for the washing apparatus according to the embodiment of the present invention includes a fabric dispersion step S100 and a spin-drying step S200.

The fabric dispersion step S100 is a step of rotating the drum 40 at a relatively low speed and uniformly dispersing the fabrics therein. The spin-drying step S200 is a step of rotating the drum 40 at a relatively high speed to remove water from the laundry.

It should be noted that the fabric dispersion step S100 and the spin-drying step S200 are named according to the main functions thereof, and the functions of each step are not limited by the name of the step. For example, in the fabric dispersion step S100, fabrics may be dispersed and water may be removed from the fabrics by rotating the drum 40. Such operations may also be performed during the spin-drying step S200.

The fabric dispersion step S100 includes at least one of a wet fabric sensing step S110 and a fabric untangling step S120. Hereinafter, each of the steps will be described in detail.

The wet fabric sensing step S110 is a step of sensing the amount of wet fabrics containing water after the rinsing operation is completed. Specifically, in the wet fabric sensing step S110, which is the first step that is performed in the spin-drying operation, the fabric amount sensing unit 81 senses the amount of fabrics in the drum 40, namely, a wet fabric amount (S110). After sensing the wet fabric amount, the fabric amount sensing unit 81 transmits information on the sensed wet fabric amount to the controller 100.

The reason for sensing the wet fabric amount is that the weight of fabrics containing water is different from the weight of the dry fabrics even though the amount of the dry fabrics, namely, a dry fabric amount, is sensed at the beginning of the washing operation. The sensed wet fabric amount serves as a factor for determining a condition for accelerating the drum 40 in an acceleration step, which will be described later, or for determining to decelerate the drum 40 in the acceleration step to perform the fabric dispersion step S100 again.

The wet fabric amount in the drum 40 is measured when the drum 40 is accelerated to a first rotation speed RPM 1, for example, about 100 to 110 RPM, preferably 108 RPM, operated at a constant speed for a predetermined time, and then decelerated. When the drum 40 is decelerated, power-generation braking is used. Specifically, the wet fabric amount is sensed using an acceleration-period rotation rate in acceleration of the drive motor 141, a deceleration-period rotation rate in deceleration, DC power applied to the motor, and the like.

After the wet fabric sensing step S110 is performed, the fabric untangling step S120 is performed. The fabric untangling step S120 is a step in which the controller 100 controls the drive unit 50 to accelerate the drum 40 such that the fabrics in the drum 40 are evenly dispersed. The fabric untangling step S120 prevents the fabrics from being concentrated in a specific area in the drum 40, which increases the degree of eccentricity of the drum 40. If the degree of eccentricity is increased, noise and vibration are increased when the rotational speed of the drum 40 increases. Specifically, the fabric untangling step S120 is performed until a rotational speed for the eccentricity sensing step, which will be described later, is reached by accelerating the drum 40 in one direction at a predetermined slope.

While the fabric dispersion step S100 has been described as including the wet fabric sensing step S110 and the fabric untangling step S120, embodiments are not limited thereto. In this step, at least one of sensing of the degree of eccentricity of the drum 40 and sensing of the vibration intensity of the drum 40 may be performed.

Referring to FIG. 3, the spin-drying step S200 of the control method for the spin-drying operation of the washing apparatus according to the embodiment of the present invention is a step of removing water contained in the laundry by rotating the drum 40, and includes a sequential process described below at least once.

First, in the spin-drying step S200, the degree of eccentricity of the drum 40 rotating at a constant speed is sensed (S310).

Then, when the degree of eccentricity exceeds a reference eccentricity degree which a reference allowable value (S320-N), the fabric dispersion is performed again (S380).

When the degree of eccentricity does not exceed the reference eccentricity degree which is the reference allowable value (S320-Y), the drum 40 is accelerated and the degree of eccentricity of the drum 40 that is being accelerated is sensed (S330).

Then, when the degree of eccentricity exceeds the reference eccentricity degree which is the reference allowable value (S340-N), the fabric dispersion is performed (S380).

When the degree of eccentricity does not exceed the reference eccentricity degree which the reference allowable value (S340-Y), a spin-drying degree indicating a dewatered state of the fabrics is set (S350).

Thereafter, a rotation time for which the drum 40 is to be rotated at spin-drying RPM is set according to the spin-drying degree. In other words, an execution time for a spin-drying RPM maintenance step is set according to the spin-drying degree (S360). Here, the spin-drying degree indicates the degree of dewatering of the laundry, and is set from the time when the degree of eccentricity exceeds a reference eccentricity degree. A detailed description of the spin-drying degree will be given later.

Thereafter, the drum 40 rotates at the spin-drying RPM for the execution time set according to the spin-drying degree (S370).

While it is described that a degree of eccentricity is sensed during acceleration of the drum 40 after a degree of eccentricity is sensed during a constant-speed rotation of the drum 40, embodiments are not limited thereto. A degree of eccentricity may be sensed during a constant-speed rotation of the drum 40 after a degree of eccentricity is sensed during acceleration of the drum 40.

The spin-drying step S200 may be performed by repeating a series of such operations several times. In addition, this series of operations may be applied to both a preliminary spin-drying step of preliminarily spin-drying the laundry and a main spin-drying step of finally spin-drying the laundry, which will be described later. In addition, the series of operations constitutes a preceding preliminary drying step and a following preliminary drying step, which will be described later.

Hereinafter, the spin-drying step S200 will be described in detail with reference to FIG. 4.

The spin-drying step S200 includes a preliminary drying step in which the laundry is spin-dried in a preliminary manner, and a main spin-drying step S270 in which the drum 40 finally rotates at a high speed to spin-dry the laundry.

The preliminary drying step is performed after the fabric dispersion step S100 is completed. The preliminary drying step includes a preceding preliminary drying step in which the laundry is preliminarily spin-dried for the first time, and a following preliminary drying step in which the laundry is spin-dried again after the preceding preliminary drying step.

As described above, a first preliminary drying step S210 is included in the preceding preliminary drying step, and a second preliminary drying step S230 and a third preliminary drying step S250 are included in the following preliminary drying step.

Both a reference eccentricity degree and a reference vibration intensity described below may be collectively referred to as a reference allowable value. The first preliminary drying step S210 includes a first eccentricity sensing step S211 of sensing the degree of eccentricity of the drum 40 rotating at a constant speed, a first acceleration step S213 of accelerating the drum 40 and sensing the degree of eccentricity of the accelerated drum 40 after the first eccentricity sensing step S211, and a first spin-drying RPM maintenance step S215 in which the drum 40 rotates while maintaining the spin-drying RPM after the first acceleration step S213.

The first eccentricity sensing step S211, which is performed after the fabric dispersion step S100, is a step in which the controller 100 controls the drive unit 50 to rotate the drum 40 at a constant speed of 100 RPM to 110 RPM (RPM1), preferably 108 RPM. Then, the eccentricity sensing unit 83 senses the degree of eccentricity of the drum 40. After sensing the degree of eccentricity of the drum 40, the eccentricity sensing unit 83 transmits the sensed degree of eccentricity to the controller 100. Upon receiving the degree of eccentricity, the controller 100 determines whether to accelerate the drum 40. This is because if the fabrics in the drum 40 are not dispersed evenly but are concentrated in a predetermined area inside the drum 40, the degree of eccentricity will be increased and increasing the rotational speed of the drum 40 will cause noise and vibration.

In an example, in the first eccentricity sensing step S211, when the drum 40 rotates, eccentricity may be sensed using, for example, a difference in acceleration. The drum 40 having eccentricity differs in acceleration between a case of rotating downward along the gravity and a case of rotating upward against the gravity, according to the degree of eccentricity. The eccentricity sensing unit 83 senses the degree of eccentricity by measuring the difference in acceleration using a speed sensor such as a Hall sensor provided in the drive motor 141, and then transmits the degree of eccentricity to the controller 100.

Therefore, in order for the eccentricity sensing unit 83 to sense the eccentricity in the first eccentricity sensing step S211, the fabrics in the drum 40 should remain stuck to the inner circumferential surface of the drum 40 without being separated from the inner circumferential surface of the drum 40 even when the drum 40 rotates. For this purpose, the drum 40 rotates at a rotational speed of approximately 100 to 110 RPM. When the degree of eccentricity of the drum 40 accommodating a certain amount of wet fabrics exceeds a reference eccentricity degree, vibration and noise of the drum 40 becomes remarkably large during acceleration of the drum 40 at a high speed. Accordingly, predetermined data about a reference eccentricity degree that allows acceleration according to the amount of the wet fabrics may be pre-stored in the controller 100 in the form of a table, and the controller 100 may determine whether to accelerate the drum by applying the sensed amount of wet fabrics and the sensed degree of eccentricity to the table. If the degree of eccentricity according to the sensed amount of wet fabrics exceeds the reference eccentricity degree, the fabric dispersion step S100 is performed again, and then the eccentricity sensing step is performed again.

In the case where the fabrics intensely tangled with each other in the drum 40 are not uniformly dispersed in the drum 40 by the fabric dispersion step S100 or an abnormality occurs in the washing apparatus, the sensed degree of eccentricity may exceed the reference eccentricity degree, and thus the fabric dispersion step S100 and the eccentricity sensing step may be continuously repeated. Accordingly, if the drum 40 is not accelerated for a predetermined time, for example, about 20 to 30 minutes after the spin-drying operation starts, the controller 100 stops rotating the drum 40, and notifies the user that the spin-drying operation has not terminated normally. When the degree of eccentricity according to the sensed amount of fabrics is lower than or equal to the reference eccentricity degree, the condition for acceleration is satisfied, and thus the spin-drying step S200 including a subsequent acceleration step is performed.

In the first acceleration step S213, the controller 100 controls the drive unit 50 to accelerate the drum 40 to a speed of 130 RPM to 150 RPM (RPM 2), and the eccentricity sensing unit 83 senses the degree of eccentricity of the drum 40. While the eccentricity sensing unit 83 is described in this embodiment as sensing the degree of eccentricity of the drum 40 in the first acceleration step S213, this step does not exclude sensing, by the vibration intensity sensing unit 85, the intensity of vibration of the drum 40. The same is applied to the second acceleration step S233, the third acceleration step S253, and a main spin-drying acceleration step S271 as well.

The first spin-drying RPM maintenance step S215 is a step of controlling, by the controller 100, the drive unit 50 to rotate the drum 40 at a first spin-drying RPM of about 130 to 150 RPM (RPM 2) to remove water from the fabrics.

In the first preliminary drying step S210, even if the degree of eccentricity of the drum 40 exceeding the reference eccentricity degree which is the reference allowable value is measured, the controller 100 may not control the drive unit 50 to stop the rotation of the drum 40 or rotate the drum at a very low speed to perform the fabric dispersion step S100. In the first preliminary drying step S210 in which the drum 40 rotates at relatively low RPM, the noise or vibration caused by the rotation of the drum 40 is not large, and accordingly the drum 40 does not need to be stopped or rotated at a low rotational speed. In addition, as water is pre-removed from the fabrics to a predetermined extent or higher, the degree of eccentricity of the drum 40 caused by the subsequent spin-drying steps S200 carried out at a high speed may be lowered.

In addition, the execution time T1 for which the first spin-drying RPM maintenance step S215 is performed may not be adjusted but be fixed depending on the spin-drying degree.

The spin-drying degree includes a first spin-drying degree, a second spin-drying degree, a third spin-drying degree and a fourth spin-drying degree, which will be described later. The spin-drying degree in the first preliminary drying step is the first spin-drying degree. The first spin-drying degree indicates a degree to which the laundry is spin-dried from the time at which the degree of eccentricity exceeds the reference eccentricity degree for the first time after initiation of the fabric untangling step S120 to the initiation time of the first spin-drying RPM maintenance step S215. The time at which the degree of eccentricity exceeds the reference eccentricity degree for the first time may be regarded as about the initiation time of re-execution of the fabric dispersion step S100 due to the degree of eccentricity exceeding the reference eccentricity degree.

In an example, the first spin-drying degree may be set by at least one of the number of times the fabric dispersion step S100 is re-executed and an average RPM of the drum in a period from the time at which the degree of eccentricity exceeds the reference eccentricity degree for the first time to the time at which the first spin-drying RPM maintenance step S215 is reached.

In this case, spin-drying data indicating the spin-drying degree is pre-stored in the controller for respective sections according to a sensed fabric amount and a progress of the spin-drying operation. The first spin-drying degree may be set in such a manner that a first weight corresponding to the number of times of the re-execution among a set of first weights sequentially set so as to be proportional to the number of times the fabric dispersion step S100 is re-executed is applied to the spin-drying data. Then, among a set of second weights set so as to be proportional to the average RPM of the drum, a corresponding second weight may be applied to the first spin-drying degree.

In another example, the first spin-drying degree may be set by at least one of a rotation time and an average RPM of the drum in a period from the time at which the degree of eccentricity exceeds the reference eccentricity degree for the first time to the time at which the first spin-drying RPM (RPM 2) is reached.

Even in this case, spin-drying data indicating the spin-drying degree is preset in the controller for respective sections according to a sensed fabric amount and a progress of the spin-drying operation. The first spin-drying degree may be set in such a manner that a third weight corresponding to the number of times of the re-execution among a set of third weights sequentially set so as to be proportional to the rotation time of the drum from the time at which the degree of eccentricity exceeds the reference eccentricity degree for the first time to the time at which the first spin-drying RPM (RPM 2) is reached. Then, among a set of fourth weights set so as to be proportional to the average RPM of the drum, a corresponding fourth weight may be applied to the first spin-drying degree.

After the first preliminary drying step S210 is performed, the second preliminary drying step S230 is performed. The second preliminary drying step S230 includes a second eccentricity sensing step S231 of sensing the degree of eccentricity of the drum 40 rotating at a constant speed, a second acceleration step S233 of sensing a vibration intensity of the drum 40 accelerated after the second eccentricity sensing step S231, and a second spin-drying RPM maintenance step S235 in which the drum 40 rotates while maintaining the spin-drying RPM after the second acceleration step S233.

In the second eccentricity sensing step S231, the controller 100 controls the drive unit 50 to rotate the drum 40 at about 100 to 110 RPM (RPM 1) as in the first eccentricity sensing step S211. Then, the eccentricity sensing unit 83 senses the degree of eccentricity of the drum 40. In a case where the sensed degree of eccentricity exceeds a reference eccentricity degree that is a reference allowable value, the controller 100 controls the drive unit 50 to stop the rotation of the drum 40 or rotate the drum 40 at a very low rotational speed and then perform the fabric dispersion step S100 again.

The second acceleration step S253 is performed in such a manner that the controller 100 controls the drive unit 50 to accelerate the drum 40 from approximately 100 to 110 RPM (RPM 1) to approximately 350 to 400 RPM (RPM 3), and the eccentricity sensing unit 83 senses the degree of eccentricity of the drum 40. The second acceleration step S253 is performed when the degree of eccentricity according to the sensed wet fabric amount is lower than or equal to the reference eccentricity degree which is the reference allowable value, that is, when the condition for acceleration is satisfied.

During the second acceleration step S253, the rotational speed of the drum 40 may pass through a transient region. Here, the transient region may be defined as a predetermined RPM band including one or more resonance frequencies at which resonance occurs depending on the system of the washing apparatus. Once the system of the washing apparatus is determined, the transient region has a characteristic of unique vibration that occurs according to the determined system. The transient region varies depending on the system of the washing machine. For example, the washing apparatus according to one embodiment of the present invention may have a transient region in the range of approximately 200 to 350 RPM. When the rotational speed of the drum 40 passes through the transient region, resonance occurs in the washing apparatus, which greatly increases the noise and vibration of the washing apparatus. The noise and vibration of the washing apparatus cause the user to feel uncomfortable, and even obstructs acceleration of the drum 40. Therefore, when the speed passes through the transient region, the acceleration slope needs to be appropriately adjusted to minimize noise and vibration.

During the second acceleration step S253, the eccentricity sensing unit 83 continuously senses the degree of eccentricity of the drum 40. This is because the vibration intensity of the drum 40 can be greatly increased if the eccentricity of the drum 40 becomes worse according to rotation of the drum 40 as the rotational speed of the drum 40 passes through the transient region or the degree of dewatering differs among the types of fabrics.

When the degree of eccentricity sensed by the eccentricity sensing unit 83 exceeds the reference eccentricity degree which is a reference allowable value, the controller 100 controls the drive unit 50 to stop the rotation of the drum 40 or rotate the drum 40 at a very low rotational speed and then perform the fabric dispersion step S100 again.

In the second spin-drying RPM maintenance step S235, the controller 100 controls the drive unit 50 to rotate the drum 40 at a second spin-drying RPM of approximately 350 to 400 RPM (RPM 3) for a preset time. A large portion of dewatering performed in the second preliminary drying step S230 occurs in the second spin-drying RPM maintenance step S235.

The execution time of the second spin-drying RPM maintenance step S235 may be fixed. If the execution time of the second spin-drying RPM maintenance step S235 is fixed, the second spin-drying RPM maintenance step S235 is performed for the fixed execution time even if the fabric dispersion step S100 is repeated several times as the degree of eccentricity continues to exceed the reference allowable value before the second spin-drying RPM maintenance step S235.

If the fabric dispersion step S100 is repeated several times, the main spin-drying step S270, which is the last step of the spin-drying operation, may not be sufficiently performed. Particularly, in the case where the execution time of the entire spin-drying operation is set, the apparatus may not even enter the main spin-drying step S270. In the case where the execution time of the entire spin-drying operation is not set, the execution time required for the entire spin-drying operation may be excessively increased.

However, since the water can be removed from the fabrics to a certain degree by the fabric dispersion step S100, which is repeatedly performed, the above-mentioned issue may be addressed as the controller 100 controls the drive unit 50 to adjust the execution time T2 of the second spin-drying RPM maintenance step S235 according to the spin-drying degree, which indicates the degree of dewatered state of the laundry, i.e., the fabrics.

The spin-drying degree may depend on the rotational speed of the drum 40 and the rotation time of the drum 40. The spin-drying degree in the second preliminary drying step S230 is the second spin-drying degree. Hereinafter, the second spin-drying degree will be described except for parts overlapping with those of the first spin-drying step.

The second spin-drying degree is set after initiation of the second preliminary drying step S230, and indicates a degree to which the laundry is spin-dried from the time at which the degree of eccentricity exceeds the reference eccentricity degree for the first time after initiation of the second preliminary drying step S230 to the initiation time of the second spin-drying RPM maintenance step S235. Here, the time at which the degree of eccentricity exceeds the reference eccentricity degree for the first time is approximately after the initiation of the second preliminary drying step S230, and may be regarded as an initiation time of re-execution of the fabric dispersion step S100 due to the degree of eccentricity exceeding the reference eccentricity degree after the initiation of the second preliminary drying step S230.

In an example, the second spin-drying degree indicates the degree to which the laundry is spin-dried after initiation of the second preliminary drying step S230, and may be set by at least one of the number of times the fabric dispersion step S100 is re-executed after the initiation of the second preliminary drying step S230, and an average RPM of the drum in a period from the time at which the degree of eccentricity exceeds the reference eccentricity degree for the first time to the time at which the second spin-drying RPM maintenance step S235 is reached.

In another example, the second spin-drying degree may be measured after the initiation of the second preliminary drying step S230, and may be set by at least one of a rotation time and an average RPM of the drum from the time at which the degree of eccentricity exceeds the reference eccentricity degree for the first time to the time at which the second spin-drying RPM (RPM 2) is reached.

The method of specifically setting the second spin-drying degree is the same as the method of setting the first spin-drying degree, and thus the description thereof is omitted.

After the second preliminary drying step S230 is performed, the third preliminary drying step S250 is performed. The third preliminary drying step S250 includes a third eccentricity sensing step S251 of sensing the degree of eccentricity of the drum 40 rotating at a constant speed, a third acceleration step S253 of sensing a vibration intensity of the drum 40 accelerated after the third eccentricity sensing step S251, and a third spin-drying RPM maintenance step S255 in which the drum 40 rotates while maintaining the spin-drying RPM after the third acceleration step S253. Some parts of the third preliminary drying step S250 are included in the second redundant step S230, and thus the description thereof is omitted.

In the third eccentricity sensing step S251, the controller 100 controls the drive unit 50 to rotate the drum 40 at about 100 to 110 RPM (RPM 1) as in the second eccentricity sensing step S231. Then, the eccentricity sensing unit 83 senses the eccentricity of the drum 40

In the third acceleration step S253, the controller 100 controls the drive unit 50 to accelerate the drum 40 from a speed of approximately 100 to 110 RPM (RPM 1) to a third spin-drying RPM of approximately 350 to 400 RPM (RPM 3) as in the second acceleration step S233.

In the third spin-drying RPM maintenance step S255, similar to the second spin-drying RPM maintenance step S235, the controller 100 controls the drive unit 50 to rotate the drum 40 at a constant speed of the third spin-drying RPM after the third acceleration step S253.

In the third spin-drying RPM maintenance step S255, the execution time T3 for which the third spin-drying RPM maintenance step S255 is performed is adjusted according to the spin-drying degree as in the second spin-drying RPM maintenance step S235.

The spin-drying degree in the third preliminary drying step S250 is the third spin-drying degree. Hereinafter, the third spin-drying degree will be described except for parts overlapping with those of the first and second spin-drying degree.

The third spin-drying degree is set after initiation of the third preliminary drying step S250, and indicates a degree to which the laundry is spin-dried from the time at which the degree of eccentricity exceeds the reference eccentricity degree for the first time to an initiation time of the third spin-drying RPM maintenance step S255. Here, the time at which the degree of eccentricity exceeds the reference eccentricity degree for the first time is approximately after the initiation of the third preliminary drying step S250, and may be regarded as an initiation time of re-execution of the fabric dispersion step S100 due to the degree of eccentricity exceeding the reference eccentricity degree.

In an example, the third spin-drying degree indicates the degree to which the laundry is spin-dried after the initiation of the third preliminary drying step S250, and may be set by at least one of the number of times the fabric dispersion step S100 is re-executed after the initiation of the third preliminary drying step S250, and an average RPM of the drum in a period from the time at which the degree of eccentricity exceeds the reference eccentricity degree for the first time to the time at which the third spin-drying RPM maintenance step S255 is reached.

In another example, the third spin-drying degree may be measured after the initiation of the third preliminary drying step S250, and may be set by at least one of a rotation time and an average RPM of the drum from the time at which the degree of eccentricity exceeds the reference eccentricity degree for the first time to the time at which the third spin-drying RPM (RPM 3) is reached.

The method of specifically setting the third spin-drying degree is the same as the method of setting the first spin-drying degree, and thus the description thereof is omitted.

Accordingly, the dewatering of the fabrics according to the fabric dispersion step S100 re-executed before or in the second preliminary drying step S230 is reflected in adjusting the execution time of the second preliminary drying step S230. That is, the execution time of the second preliminary drying step S230 is adjusted by at least one of the first spin-drying degree and the second spin-drying degree.

In addition, the dewatering of the fabrics according to the fabric dispersion step S100 re-executed in the third preliminary drying step S250 after the second preliminary drying step S230 may be reflected in adjusting the execution time of the third preliminary drying step S250. That is, the execution time of the third preliminary drying step S250 is adjusted by the third spin-drying degree.

After the preliminary drying steps are performed, the main spin-drying step S270 is performed. The main spin-drying step S270 includes a main spin-drying acceleration step S271 and a main spin-drying RPM maintenance step S273, but the rotational speed of the drum 40 is not reduced to 100 to 110 RPM (RPM 1). Accordingly, after the third spin-drying RPM maintenance step S255 of the third preliminary drying step S250 is completed, the drum 40 is not decelerated, but is accelerated as it enters the main spin-drying acceleration step S271.

In the main spin-drying RPM maintenance step S273, the controller 100 controls the drive unit 50 to accelerate the drum 40 from about 350 to 400 RPM (RPM 3) to a main spin-drying RPM of about 1000 to 1200 RPM (RPM 4). In addition, the main spin-drying RPM maintenance step S273 is the same as the second acceleration step S233 and the third acceleration step S253 in that the eccentricity sensing unit 83 measures the degree of eccentricity of the drum 40 and then the fabric dispersion step S100 is repeated when the measured degree of eccentricity exceeds the reference eccentricity degree.

In the main spin-drying RPM maintenance step S273, the controller 100 controls the drive unit 50 to rotate the drum 40 at a constant RPM. The main spin-drying RPM maintenance step S273 is performed when the degree of eccentricity measured in the main spin-drying acceleration step S271 does not exceed the reference allowable value. As in the second spin-drying RPM maintenance step S235 and the third spin-drying RPM maintenance step S255, the execution time for which the main spin-drying RPM maintenance step S273 is performed may be adjusted according to the fourth spin-drying degree indicating the degree of dewatering of the fabrics occurring in the fabric dispersion step S100 or the like repeated several times.

The fourth spin-drying degree is set after initiation of the main spin-drying step S270, and indicates a degree to which the laundry is spin-dried from the time at which the degree of eccentricity exceeds the reference eccentricity degree for the first time to an initiation time of the main spin-drying RPM maintenance step S273. The time at which the degree of eccentricity exceeds the reference eccentricity degree for the first time is approximately after the initiation of the main spin-drying step S270, and may be regarded as an initiation time of re-execution of the fabric dispersion step S100 due to the degree of eccentricity exceeding the reference eccentricity degree In an example, the fourth spin-drying degree indicates the degree to which the laundry is spin-dried after the initiation of the main spin-drying step S270, and may be set by at least one of the number of times the fabric dispersion step S100 is re-executed after the initiation of the main spin-drying step S270, and an average RPM of the drum in a period from the time at which the degree of eccentricity exceeds the reference eccentricity degree for the first time to the time at which the main spin-drying RPM maintenance step S273 is reached.

In another example, the fourth spin-drying degree may be set by at least one of a rotation time and an average RPM of the drum from the time at which the degree of eccentricity exceeds the reference eccentricity degree for the first time to the time at which the main spin-drying RPM is reached.

The method of specifically setting the fourth spin-drying degree is the same as the method of setting the first spin-drying degree, and thus the description thereof is omitted.

Accordingly, the execution time for which the main spin-drying RPM maintenance step S273 is performed may be adjusted in consideration of dewatering of the fabrics between the end of the third preliminary drying step S250 and the start of the main spin-drying RPM maintenance step S273.

In the main spin-drying acceleration step S271, the slope may be adjusted to secure the execution time for which the main spin-drying RPM maintenance step S273 is performed. In other words, the time required for the drum 40 to accelerate from approximately 350 to 400 RPM (RPM 3) to the main spin-drying RPM of approximately 1000 to 1200 RPM (RPM 4). The execution time of the main spin-drying RPM maintenance step S273 may be secured to a certain level or more because the water is mostly removed from the fabrics as the drum 40 rotates at the highest rotational speed in the main spin-drying RPM maintenance step S273.

Therefore, if the time of entry into the main spin-drying step S270 measured according to several times of repetition of the fabric dispersion step S100 is later than a preset entry time, the drum 40 is rotated faster in the main spin-drying acceleration step S271 to shorten the execution time of the main spin-drying acceleration step S271 as much as possible so as to promptly enter the main spin-drying RPM maintenance step S273.

In another example, the main spin-drying acceleration step S271 may be set such that the execution time of the main spin-drying acceleration step S271 is shortened as much as possible even by the fourth spin-drying degree.

While the present invention has been particularly shown and described with reference to exemplary embodiments and the accompanying drawings thereof, it is to be understood that the invention is not limited to the disclosed exemplary embodiments and the drawings. It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for controlling a spin-drying operation of a washing apparatus, the method comprising:

a fabric dispersion step of dispersing laundry in a drum by accelerating the drum to a first RPM; and a main spin-drying step of rotating the drum at a main-spin-drying RPM such that the laundry is finally spin-dried;

a preliminary spin-drying step performed before the main spin-drying step, wherein the preliminary spin-drying step comprises:

an eccentricity sensing step of sensing a degree of eccentricity of the drum rotating at the first RPM;

an acceleration step of accelerating the drum to a preliminary spin-drying RPM when the degree of eccentricity is lower than or equal to a reference eccentricity degree; and a spin-drying RPM maintenance step of performing spin-drying by rotating the drum at the preliminary spin-drying RPM during a rotation time, wherein the fabric dispersion step is re-executed if the degree of eccentricity exceeds the reference eccentricity degree, and wherein the rotation time is adjusted according to a spin-drying degree indicative of a dewatered degree of the laundry.

2. The method according to claim 1, wherein the spin-drying degree is set based on at least one of the number of times the fabric dispersion step is re-executed and an average RPM of the drum between an exceeding time at which the degree of eccentricity exceeds the reference eccentricity and a time at which the spin-drying RPM reaches the preliminary spin-drying RPM.

3. The method according to claim 2, wherein the preliminary spin-drying step comprises:

a preceding preliminary spin-drying step of rotating the drum at a preceding-preliminary-drying RPM for a rotation first time; and a following preliminary spin-drying step of rotating the drum at a following-preliminary-drying RPM after the preceding preliminary spin-drying step.

4. The method according to claim 3, wherein the spin-drying degree comprises:

a first spin-drying degree set before a time at which the preceding-preliminary-drying RPM is reached; and a second spin-drying degree set before a time at which the following-preliminary-drying RPM is reached after the first spin-drying degree is set, wherein a rotation time for which the drum rotates at the following-preliminary-drying RPM in the following preliminary spin-drying step is adjusted according to the first and second spin-drying degrees.

5. The method according to claim 4, wherein a rotation time for which the drum rotates at the preceding-preliminary-drying RPM in the preceding preliminary spin-drying step is fixed.

6. The method according to claim 4, wherein the following-preliminary-drying RPM is set to be higher than the preceding-preliminary-drying RPM.

7. The method according to claim 1, wherein the spin-drying degree is set based on at least one of a rotation time and an average RPM of the drum between an exceeding time at which the degree of eccentricity exceeds the reference eccentricity and a time at which the spin-drying RPM reaches the preliminary spin-drying RPM.

8. The method according to claim 1, wherein the main spin-drying step comprises:

a main-spin-drying acceleration step of accelerating the drum to the main-spin-drying RPM; and a main-spin-drying maintenance step of rotating the drum at the main-spin-drying RPM after the main-spin-drying acceleration step.

9. The method according to claim 8, wherein an acceleration of the drum in the main-spin-drying acceleration step is adjusted by the spin-drying degree.

10. The method according to claim 8, wherein a time of entry into the main-spin-drying acceleration step is determined in the main spin-drying step, wherein, when the time of entry is later than a preset entry time, an acceleration of the drum in the main-spin-drying acceleration step is increased.

* * * * *